US009443412B2

(12) United States Patent
Barrena et al.

(10) Patent No.: US 9,443,412 B2
(45) Date of Patent: Sep. 13, 2016

(54) MODULATED AUDIO ANNUNCIATOR PROVIDING STAND-ALONE HIGH VOLTAGE COMPATIBILITY

(71) Applicant: ILLINOIS TOOL WORKS INC., Glenview, IL (US)

(72) Inventors: Juan Barrena, Johnston, RI (US); Andrew W. Tucker, Pawtucket, RI (US); Eric K. Larson, Cumberland, RI (US); Jeffrey L. Prunty, Wrentham, MA (US)

(73) Assignee: Illinois Tool Works, Inc., Glenview, IL (US)

( * ) Notice: Subject to any disclaimer, the term of this patent is extended or adjusted under 35 U.S.C. 154(b) by 44 days.

(21) Appl. No.: 14/420,383

(22) PCT Filed: Aug. 15, 2013

(86) PCT No.: PCT/US2013/055189

§ 371 (c)(1),
(2) Date: Feb. 9, 2015

(87) PCT Pub. No.: WO2014/028764

PCT Pub. Date: Feb. 20, 2014

(65) Prior Publication Data

US 2015/0221204 A1 Aug. 6, 2015

Related U.S. Application Data

(60) Provisional application No. 61/683,997, filed on Aug. 16, 2012.

(51) Int. Cl.
*G08B 21/00* (2006.01)
*G08B 21/18* (2006.01)

(Continued)

(52) U.S. Cl.
CPC ..... *G08B 21/18* (2013.01); *D06F 39/005* (2013.01); *F25D 29/00* (2013.01); *F25D 29/008* (2013.01); *G08B 3/10* (2013.01); *D06F 2058/2883* (2013.01)

(58) Field of Classification Search
CPC ..... F25D 29/00; G08B 21/18
USPC ..... 340/635, 540, 529, 545.6, 585
See application file for complete search history.

(56) References Cited

U.S. PATENT DOCUMENTS 5,070,319 A * 12/1991 Scuka ..... F25D 29/008 310/323.21
5,451,930 A * 9/1995 McDaniel ..... F25D 29/008 340/521

(Continued)

FOREIGN PATENT DOCUMENTS

CN 2115504 U 9/1992
CN 2119620 U 10/1992

(Continued)

OTHER PUBLICATIONS

ISR and WO for PCT/US2013/055189 mailed Dec. 11, 2013.

*Primary Examiner* — Phung Nguyen
(74) *Attorney, Agent, or Firm* — Boyle Fredrickson, S.C.

(57) ABSTRACT

An integrated line voltage converter and microprocessor-controlled tone generator allow advanced alarm features to be implemented in standard appliances as powered by a high-voltage line power. An integrated switch may also be used to allow the addition of alarm features to standard appliances as a drop-in replacement for door switches.

11 Claims, 4 Drawing Sheets

(51) Int. Cl.

| | |
|---|---|
| ***D06F 39/00*** | (2006.01) |
| ***F25D 29/00*** | (2006.01) |
| ***G08B 3/10*** | (2006.01) |
| *D06F 58/28* | (2006.01) |

(56) References Cited

U.S. PATENT DOCUMENTS

| | | | | |
|---|---|---|---|---|
| 5,479,152 | A * | 12/1995 | Walker | F25D 29/008 200/61.62 |
| 6,060,987 | A * | 5/2000 | Marlia | F25D 29/008 340/529 |
| 6,375,038 | B1 * | 4/2002 | Daansen | A47K 5/1217 222/39 |
| 2011/0157930 | A1 | 6/2011 | Wu et al. | |

FOREIGN PATENT DOCUMENTS

| | | | |
|---|---|---|---|
| CN | 2904146 | Y | 5/2007 |
| CN | 102252481 | A | 11/2011 |
| CN | 202216482 | U | 5/2012 |
| EP | 0463428 | A2 | 1/1992 |
| GB | 2341260 | A | 3/2000 |

* cited by examiner

MODULATED AUDIO ANNUNCIATOR PROVIDING STAND-ALONE HIGH VOLTAGE COMPATIBILITY

CROSS REFERENCE TO RELATED APPLICATION

The present application is National Phase of International Application Number PCT/US2013/055189 filed Aug. 15, 2013 and claims the benefit of U.S. provisional 61/683,997 filed Aug. 16, 2012 and hereby incorporated by reference.

FIELD OF THE INVENTION

The present invention relates to household appliances and in particular to an audible signaling device for household appliances that provides a modulated tone.

BACKGROUND OF THE INVENTION

Many household appliances provide an audio signal to alert the owner to the need to take timely action. For example, many dryers have an "end of cycle" audible signal that is activated when the drying cycle has been completed so that the user may remove clothes before wrinkles "set". This signal is normally provided by high voltage (110-120 volts) electromechanical "buzzer". Such buzzers provide a relatively harsh single tone, the latter limiting their use to conveying one type of information.

High-end refrigerators providing microprocessor control circuits may monitor whether the refrigerator door is fully closed and sound a tone when the door is left ajar by a small amount that might otherwise go unnoticed. Such failure of the refrigerator door to seal wastes energy, causes condensation, and can affect the condition of the food. These refrigerators may provide the warning tone using a small piezoelectric audio transducer driven by the low voltage microprocessor circuitry. Modulation of the tone using software executed by the microprocessor can provide for a tone that is both distinctive and pleasant sounding. Modulation of the tone can allow multiple different conditions to be signaled.

The use of a modulated audio transducer, such as a piezoelectric transducer, to provide an alert to the appliance owner has not been adopted widely in lower end appliances or appliances that do not normally include a microprocessor controller, primarily because the incremental cost of such transducers, including the necessary low-voltage power source, interconnecting wiring and support circuitry, cannot be cost justified despite the desirability of modulated audio for aesthetic and functional purposes.

SUMMARY OF THE INVENTION

The present invention provides a standalone modulated audio transducer for use in appliances that may not have pre-existing low-voltage power supplies attendant to microprocessor control circuitry or the ability to use an existing microprocessor for tone modulation. In one embodiment, the invention provides an audio alarm system suitable for incorporation into the wiring already devoted to a door sensing switch, for example, the latter for controlling illumination of an interior light.

In this regard, one embodiment of the invention provides an appliance alarm for an appliance. The appliance alarm includes a housing providing a mounting element for attaching the appliance alarm to the appliance and a conductor system providing an electrical connection between the appliance alarm and line power from the appliance. A circuit card retained at least in part within the housing includes: (a) a power converter converting line-voltage alternating current to logic level direct-current; (b) a piezoelectric annunciator; and (c) a microprocessor receiving the logic level direct-current and providing an output line communicating with the piezoelectric annunciator to provide a modulated signal to the piezoelectric annunciator to produce a distinctive modulated audio tone.

It is thus a feature of at least one embodiment of the invention to provide a self-contained modulated tone generator for use in appliances for operation directly with line voltage. It is a feature of at least one embodiment of the invention to permit modulated tone generation in lower end appliances that cannot provide ready access to logic level voltages needed for modulation circuits.

The appliance alarm may further include an electrical switch having a switch operator extending from the housing to move between an open and closed state, the switch operator communicating with electrical contacts providing an electrical signal to the microprocessor.

It is thus a feature of at least one embodiment of the invention to provide a modulated tone generator that may replace a conventional door switch with a concomitant savings in structure and cost.

The electrical switch may communicate between the logic level direct-current from the power converter and an input from the microprocessor.

It is thus a feature of at least one embodiment of the invention to permit the use of a lower-cost low-voltage door switch in a line voltage powered system.

Alternatively, the electrical switch may communicate between the connector providing electrical connection to line power and the power converter.

It is thus a feature of at least one embodiment of the invention to provide a modulated tone assembly that may be integrated with the conventional high-voltage door switch, for example, used to control a high-powered element such as an incandescent bulb.

The power converter may provide a current flow through connectors connecting the power converter to line power of at least 100 milliamps and a voltage drop of less than 50 volts so that when the electrical switch is closed, a standard line voltage incandescent bulb in series with the power converter is substantially fully illuminated when the switch is closed and turned off when the switch is open.

It is thus a feature of at least one embodiment of the invention to permit a series connection of the modulated alarm circuit with a high-voltage door switch and light.

The switch operator may be positioned to move between the first and second state in a plane parallel to a plane of the circuit card.

It is thus a feature of at least one embodiment of the invention to provide an extremely narrow form factor that may be integrated into an appliance wall for door switch operation.

The switch may be supported for motion by the housing and printed circuit board and include switch contacts electrically supported by the printed circuit board.

It is thus a feature of at least one embodiment of the invention to provide a sharing of mechanical and electrical structure of the switch and alarm to provide cost-effective freestanding system.

The piezoelectric annunciator may be a metallic disk including a coating of piezoelectric material, the disk supported by and electrically communicating through its edges with the circuit card. The housing may provide a resonator chamber positioned adjacent to the piezoelectric annunciator.

It is thus a feature of at least one embodiment of the invention to provide electrical and mechanical structure needed for a piezoelectric annunciator using a shared portion of the printed circuit board to provide a more compact and lower-cost unit.

The power converter may employ multiple series-connected discrete resistors to provide a reduction in line voltage, the discrete resistors spaced over a surface of the printed circuit board.

It is thus a feature of at least one embodiment of the invention to provide distributed power dissipation to eliminate hot spots or bulky power resistors when significant power must be dissipated.

The conductor system may further include a low voltage electrical connector providing a logic level direct current signal to the microprocessor and wherein the microprocessor responds to the logic level direct-current signal by changing a modulated signal to provide a second distinctive modulated audio tone.

It is thus a feature of at least one embodiment of the invention to provide multiple externally triggered modulated tones.

Alternatively or in addition, the microprocessor may provide a first modulated signal for a first period of time and start an internal timer upon the starting of the first modulated signal and provide a second modulated signal for a second period of time upon expiration of the timer.

It is thus a feature of at least one embodiment of the invention to provide a sophisticated tone system that may provide time changing signals, for example, to signal a door ajar.

The housing may include an electrical connector shell allowing a mating connector to fit within the electrical connector shell and connect with connector pins attached to the printed circuit card.

It is thus a feature of at least one embodiment of the invention to integrate the connector shell into the housing to increase the practicality of an integrated assembly in low-cost appliances.

Other features and advantages of the invention will become apparent to those skilled in the art upon review of the following detailed description, claims and drawings in which like numerals are used to designate like features.

Figure 1:
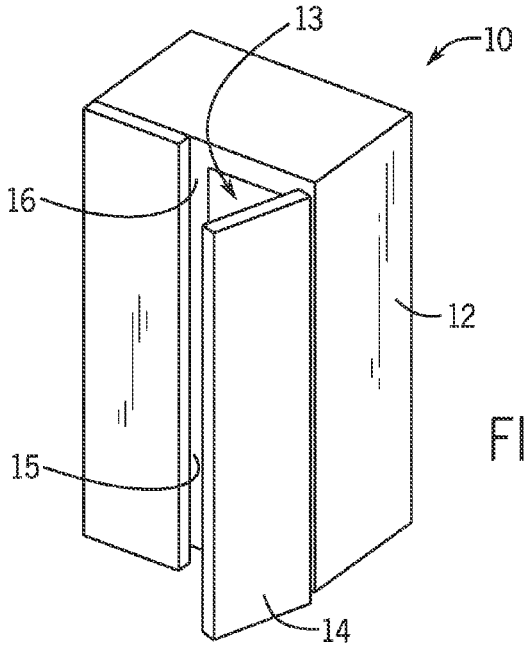
FIG. 1 is a simplified perspective view of a refrigerator showing a door switch of a type that may be implemented by the present invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENTS

Referring now to FIG. 1, an appliance 10 such as a refrigerator may provide for a housing 12 enclosing a volume 13 accessible through a pivoting door 14. The door 14 may contact a frame element 15 supporting an appliance alarm 16 that may be activated by opening of the door 14.

Figure 2:
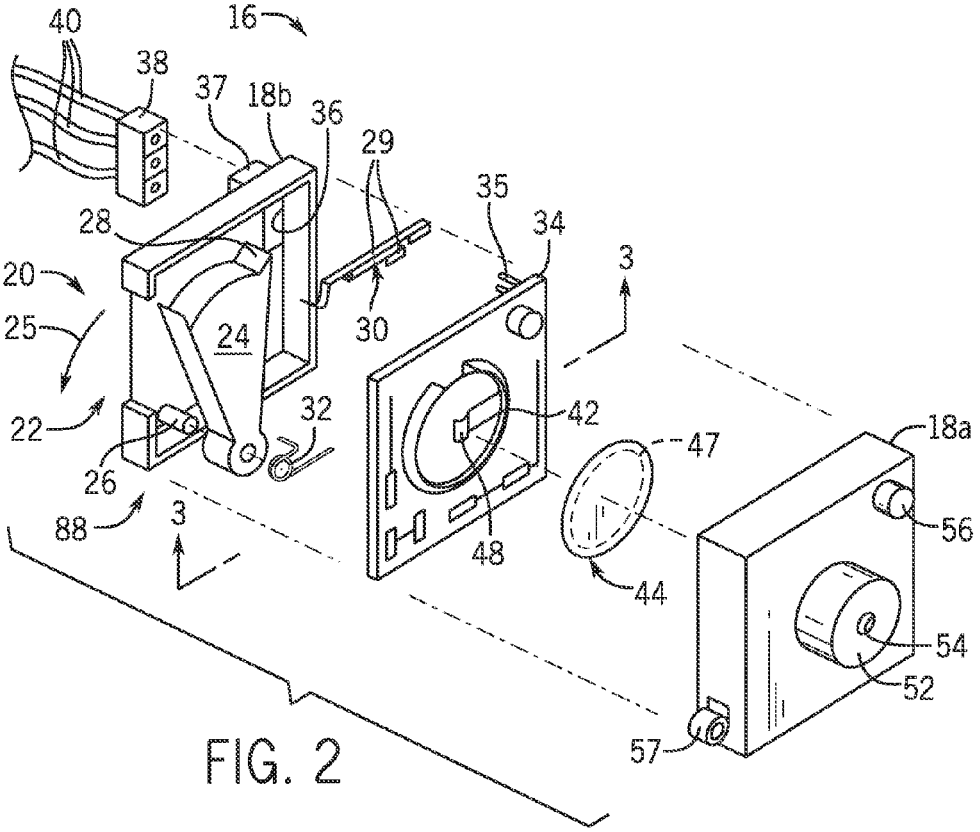
FIG. 2 is an exploded perspective view of the door switch of FIG. 1 showing a housing containing a switch operator and a circuit card, the latter holding a piezoelectric transducer and switch contacts for the switch as well as an unregulated power converting circuit.

Referring to FIG. 2, the appliance alarm 16 may in one embodiment provide for a generally rectangular housing separable into a front and back housing portion 18*a* and 18*b* together providing one edge 20 exposed at the frame element that presents an opening 22 therein. A pivoting switch operator 24 may pivot about a post 26 extending inward from a front face of the back housing portion 18*b* along an axis generally perpendicular to an axis 25 of movement of the switch operator 24 upon contact within interface of the door 14. The pivoting switch operator 24 may pivot to extend through the opening 22 when in a fully extended or open position and retract into that opening 22 under the force of the closing door 14 when in a retracted or closed position.

An upper portion of the pivoting switch operator 24 may provide for a cam surface 28 that may interact with a pair of metallic leaf springs 29, the latter providing electrical contacts 30 that are normally spring-biased closed but that are separated when the pivoting switch operator 24 extends fully from the housing through opening 22 indicating an open door 14. In this state of full extension, the cam surface 28 presses one of the metallic leaf springs 29 upward to separate from the other and in this manner opens the contacts 30. The pivoting switch operator 24 may be biased toward this outward position by a torsion spring 32 retained about the post 26 as is generally understood in the art. Together these components of the metallic leaf springs 29, pivoting switch operator 24 cam surface 28 and contacts 30 provide an electrical switch 88.

The metallic leaf springs 29 of the contacts 30 may be mechanically attached at one end to a rear side of a circuit board 34 contained within the housing portions 18*a* and 18*b* when they are assembled together. The circuit board 34 may be a printed circuit board with traces on a front and rear surface created by standard etching processes and intercommunicating by conductive vias or spanning component connectors.

The attachment of the metallic leaf springs 29 to the circuit board 34 may be accomplished, for example, by soldering flanges on the metallic leaf springs 29 to traces on a rear surface of the printed circuit board 34 (not shown). In this way the circuit board 34 provides structure required in an electrical switch to stabilize contacts 30, and the housing portion 18*a* provides a structure supporting the pivoting switch operator 24 and torsion spring 32. Electrical components such as resistors, capacitors, diodes and the like may be attached to the traces on the printed circuit board 34 as is generally understood in the art to provide circuitry described below.

A set of electrically conducting connector pins 35 may extend from the rear surface of the circuit board 34 as attached by solder to electrical traces and be stabilized within holes in the printed circuit board 34. These connector pins 35 may extend through an opening 36 in a rear face of the housing portion 18*a* to be connected to an electrical connector 38 that may join with line power (e.g. 110-120 volts) available in the appliance 10 as provided through one or more conductors 40. The electrical connector 38 may mate with a connector shell 37 formed about the opening 36 on a rear face of back housing portion 18*b*. Electrical power in the form of AC line voltage 41 of approximately 110-220 volts may be provided to the circuitry on the circuit board 34 through the connection of electrical connector 38 and the pins 35*e* which form the connecting conductor system as will be described below.

The center of the circuit board 34 may include a circular bore 42 sized to be slightly smaller than a diameter of a piezoelectric vibrating element 44 (e.g., a bender), the latter typically being a thin brass disk 45 coated on a rear side with a ceramic piezoelectric material 47. The piezoelectric vibrating element 44 provides an audio annunciator.

Figure 3:
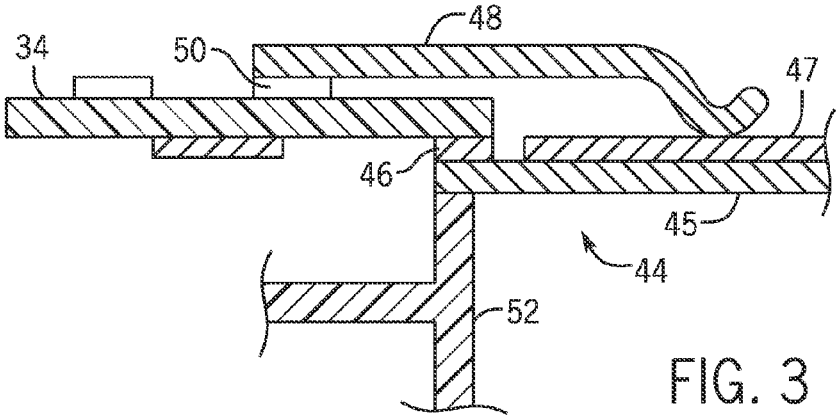
FIG. 3 is a cross-section along the lines 3-3 of FIG. 2 showing a capturing of a piezoelectric element between the circuit card and a spring finger attached to the circuit card.

Referring now also to FIG. 3, the bore 42 may be ringed by a conductive trace 46 formed on a front surface of the circuit board 34. This conductive trace 46 may contact a rear surface of the brass disk 45 of the piezoelectric vibrating element 44 when the latter is placed on top of the circular bore 42 to provide electrical contact with one side of the piezoelectric material 47 on the piezoelectric vibrating element 44. This connection may be a sliding connection to permit free vibration and expansion or contraction of the piezoelectric vibrating element 44 or may be a soldered connection to the piezoelectric vibrating element 44 or connection through a conductive adhesive tape or the like.

A flexible metal finger 48 may extend in cantilevered fashion to a center of an opposite side of the bore 42 from an attachment point on another trace 50 on the printed circuit board 34 on its rear side and opposite traces 46 to contact the piezoelectric material 47 directly. Electrical connections on both sides of the piezoelectric material 47 of the piezoelectric vibrating element 44 allow it to be flexed by the application of voltage across these connections as is generally understood in the art.

Referring still to FIGS. 2 and 3, front housing portion 18*a* may cover the piezoelectric vibrating element 44 and provide an outwardly extending resonator chamber 52 having an opening 54 to allow the sound to exit while also providing a resonant volume adjacent to a front of the piezoelectric vibrating element 44 to provide a desired coloring of the sound while still largely shielding the inside of the housing 18 from moisture and debris. The resonator chamber 52 may include a lip 53 that presses inward on the piezoelectric vibrating element 44 at its periphery to hold the piezoelectric vibrating element 44 against the trace 46.

The front housing portion 18*a* may be sized to closely conform to the upper surface of the printed circuit board 34 so as to reduce material costs but may provide for protrusions 56 for extra-tall circuit elements such as a capacitor as will be described. Housing portion 18*a* may include one or more attachment points 57 allowing it to be attached to the appliance in a convenient manner and/or to assemble the housing portion 18*a* and 18*b* together. It will be appreciated that other methods of assembling the housing portion 18*a* and 18*b* together may be used including ultrasonic welding adhesive and the like.

Figure 4:
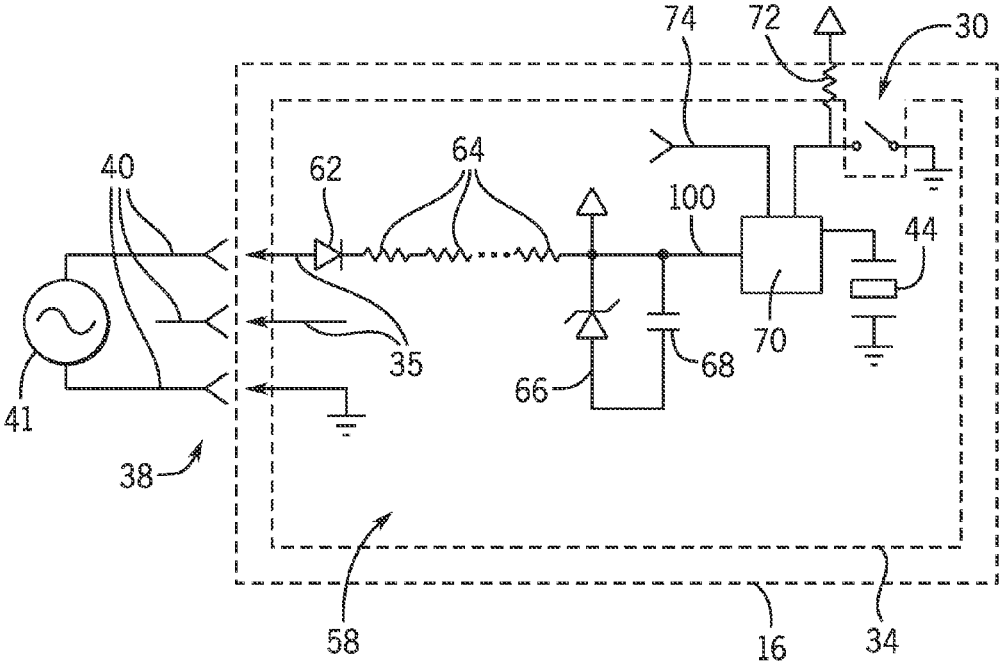
FIG. 4 is a schematic of the circuit of the circuit card.

Referring now to FIG. 4, the circuit board 34 may support circuitry 58 receiving line voltage 41 through conductors 40 and electrical connector 38 into pins 35 attached to the circuitry 58. A "hot" side of the line voltage 41 may be received by the anode of a rectifier diode 62 providing half-wave rectified DC. This rectified DC may be reduced in voltage through a set of discrete, series-connected resistors 64 spaced apart on the surface of the printed circuit board 34 for proper heat dissipation. The resistors 64 join with the cathode of a zener diode 66 which together with capacitor 68 (connected in parallel across zener diode 66) to a common ground point provide a source of low-voltage logic level DC (approximately 5 volts) to a microcontroller 70. Generally level voltage will be substantially 3 to 10 volts and/or a voltage compatible with direct connection to integrated circuitry. In one embodiment, resistors 64 are sized to provide in series an approximately 105 to 115 volts drop with a current of about 20 milliamps less and each having a power dissipation of about one quarter watt. Each of the resistors may for example be about 60 ohms and eight resistors may be connected in series. (?)

The low-voltage DC 100 is provided to a microcontroller 70 to provide power to the microcontroller 70. The microcontroller 70 may, for example, be a six-pin microcontroller manufactured by Microchip Technology Inc. of Chandler, Ariz. such as the PIC10F200 providing sixteen bytes of RAM memory, 370 bytes of flash programmable program memory and a single 8-bit timer and the ability to sink or source twenty-five milliamps of I/O current. A microcontroller 70 may receive an input from the switch contacts 30, for example, having one contact connected to ground and the other connected to an input of the microcontroller 70 that is pulled up by resistor 72. The microcontroller 70 may also receive a programming input 74 that may, for example, be received from another component of the appliance 10 to change the particular modulation pattern. One output of the microcontroller 70 may be used to drive the piezoelectric vibrating element 44 by providing a pulsed output to the piezoelectric vibrating element 44.

Figure 5:
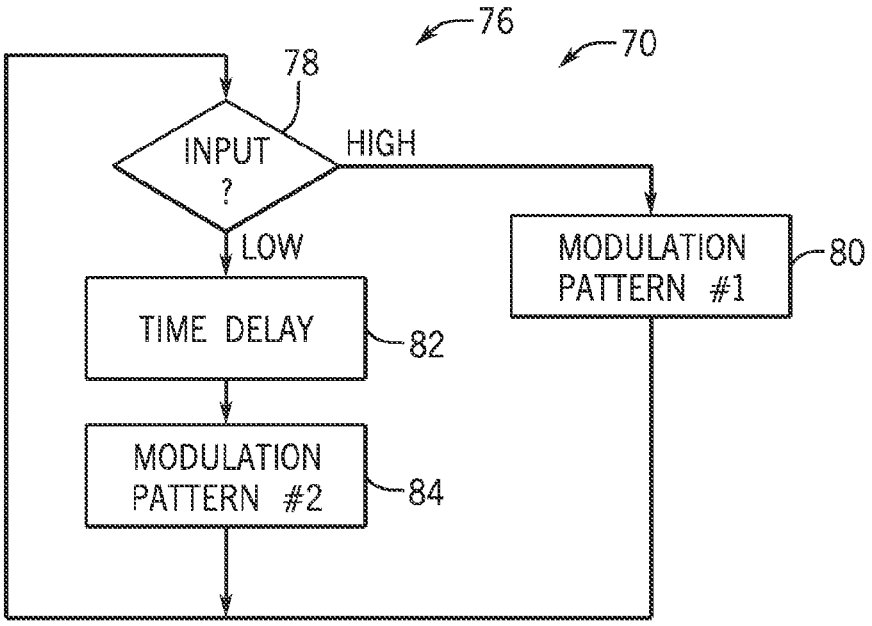
FIG. 5 is a simplified flowchart of a program executed by a modulator circuit on the circuit card.

Referring now to FIG. 5, the microcontroller 70 may be preprogrammed with a program 76 to interrogate the input 74 at decision block 78 to determine which type of modulation pattern should be adopted. If the input 74 is high (nominally five volts) the program 76 in the microcontroller 70 proceeds to process block 80 to provide a first modulation pattern, for example a continuous tone.

If at decision block 78, the input 74 is low (nominally zero volts), microcontroller 70 may proceed to process block 82 and a time delay may be implemented, for example, providing the user with a predetermined amount of time during which the door of the refrigerator may be open before an alarm is sounded. The time may be determined by a loop executing in software or an internal timer. At the conclusion of this time delay as indicated by process block 84, a second modulation tone may be adopted, for example an intermittent pulsing of the piezoelectric vibrating element 44 at a frequency below audio frequencies (for example, once every half second). It will be appreciated that a variety of different modulation patterns may be adopted including those which provide two audio modulations to create overtones and harmonics or that use different timings or lengths of pulses.

Alternatively, the internal timer may be used to terminate the alarm signal after a period of time, for example when the alarm is used to indicate cycle completion in the dryer or the like.

Figure 6A:
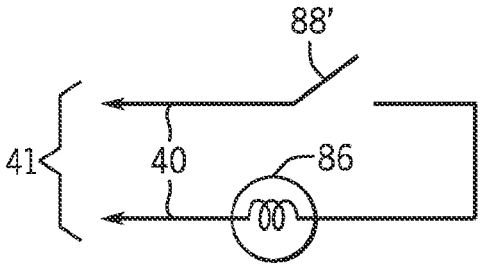
FIG. 6a PRIOR ART
FIGS. 6*a* and 6*b* are respectively a prior art circuit for a door switch and that circuit incorporating a second embodiment of the invention.

Referring now to FIG. 6*a*, existing appliances, and in particular refrigerators, may provide for an interior lamp 86 controlled by a door switch 88 connected in series with the light 86, the series connection receiving a source of AC line voltage 41 through conductors 40. Typically, the light 86 may be an incandescent bulb having a voltage rating equal to that of the AC line voltage 41; although high-voltage LED modules are also contemplated. The door switch 88 may likewise be a high current, high-voltage switch compatible with the power requirements of light 86.

Figure 6B:
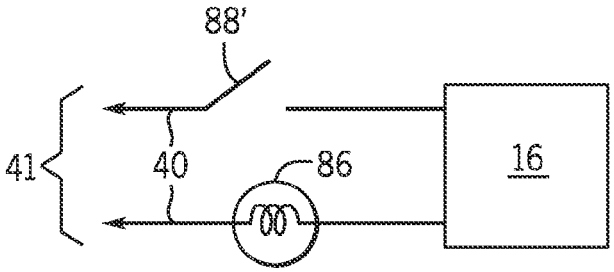

Referring to FIG. 6*b*, the dedicated wiring and the elements of switch 88 and light 86 may work with a second embodiment of the present invention providing a door appliance alarm 16 that may be connected in series at any point with the door switch 88' (inside or outside of the housing formed by portions 18*a* and 18*b*) and/or light 86 to make use of the signal provided by the interruption of line voltage 41 by the switch 88 (which indicates the opening of the door 14) and to make use of the line voltage power provided by the connection to line voltage 41. It will be appreciated that a "signal" can be generally a voltage or absence of voltage depending on context.

Figure 7:
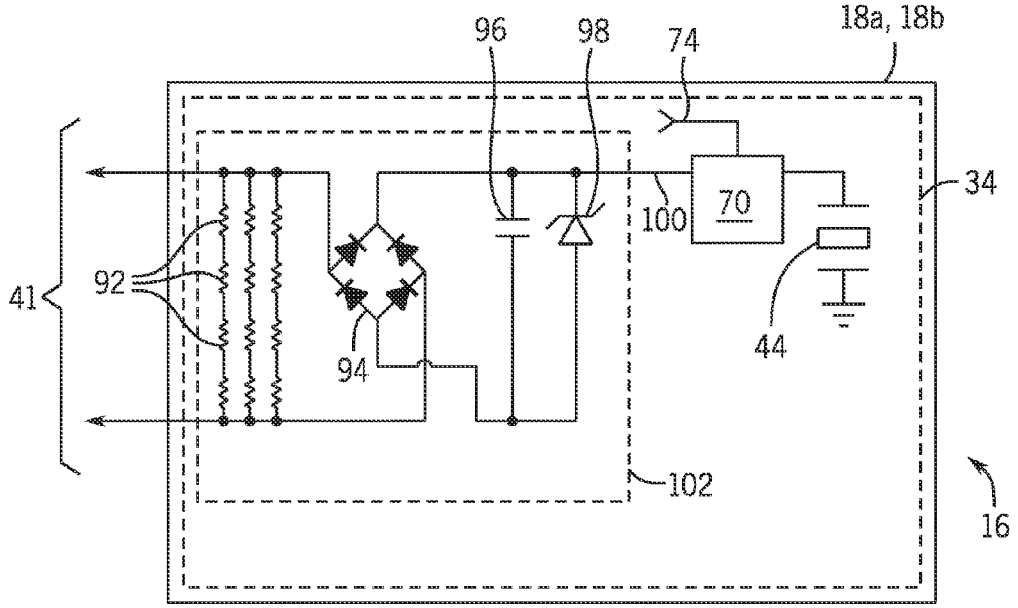
FIG. 7 is a schematic similar to that of FIG. 4 of the second embodiment of the invention that may work with a pre-existing door switch circuit.

Referring now to FIG. 7, line voltage 41 provided by the circuit of FIG. 6*b* as interruptible by door switch 88, may be received across a set of high dropping resistors 92. These dropping resistors 92 are intended to pass sufficient current at 120 volts to provide for illumination of the interior lamp 86 without noticeable dimming (in comparison to the illumination of interior lamp 86 with the circuit of FIG. 6*a*) yet to provide a voltage drop across all of them between 3 and 5.5 volts for operation of the microcontroller 70. In one embodiment, three parallel ranks of four series-connected resistors 92 may be used, each resistor 92 having a resistance of about 9 ohms for total resistance across line voltage 41 of about 12 ohms.

By using multiple dropping resistors 92, the total power dissipation per resistor may be reduced to less than one-quarter watt to prevent hotspots and to allow use of relatively compact resistances.

The voltage taken across these resistors 92 may be rectified by a full wave rectifier 94 and provided to a filter capacitor 96 and a Zener diode 98 to provide filtered DC voltage 100 of about 4.7 volts to the microcontroller 70. The elements of the resistances 92, full wave rectifier 94, capacitor 96, and Zener diode 98 together provide an in-line-power supply unit 102 deriving power for operation of the microcontroller 70 without interfering with power provided to the interior lamp 86.

This voltage 100 from the power supply unit 102, as noted, may again provide power to the microcontroller 70 which, in the presence of voltage 100, may begin execution of an internal program to provide a modulated alarm signal to the vibrating element 44. The microcontroller 70 may optionally provide for various inputs 74 which may be controlled externally or set by means of jumpers to also provide for different types of modulation as was described before. In general operation, when the switch 88' is open (corresponding to a closed door 14 on the appliance 10 shown in FIG. 1), no power is provided to the microcontroller 70 or to the vibrating element 44. In contrast, when the switch 88' is closed corresponding to an open door 14, power is provided to the microcontroller 70 which executes an internal time delay and then provides a modulated signal to the vibrating element 44 indicating that the door 14 is ajar.

Figure 8:
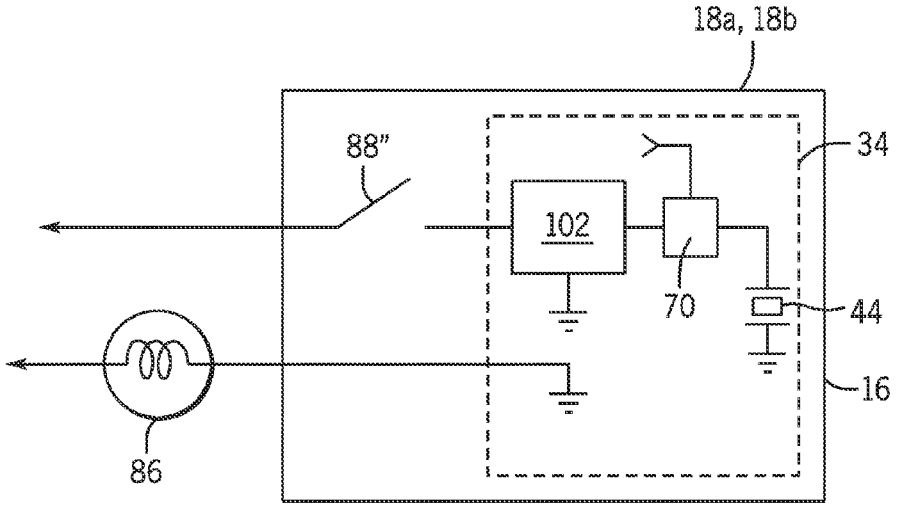
FIG. 8 is an alternative embodiment of the circuit of FIG. 7 also providing the door switch.

Referring now to FIGS. 2 and 8, it will be appreciated that the door switch 88" may be incorporated into the appliance alarm 16 within the housing formed by portions 18*a* and 18*b* using the mechanisms described above with respect to FIG. 2 by providing higher current contacts 30 (shown in FIG. 2). In this way a drop-in compatible appliance alarm 16 may be provided for appliances 10 having standard door switches used to operate interior lamps 86, the appliance alarm 16 replacing the entire door switch.

Generally, it will be appreciated that the housing need not fully enclose the circuit board and may be formed of portions of the appliance wall or other appliance structure attached to the appliance. It will be appreciated that the alarm may be used in other appliances than refrigerators, for example in ovens to signal a desired temperature has been reached (preheating) or dryers to indicate that a cycle is complete or clothing is dry.

Variations and modifications of the foregoing are within the scope of the present invention including replacement of the piezoelectric element with an electrodynamic "loudspeaker" using a magnet and coil. The invention may be used with or without the contained electrical switch and has application to a variety of appliances including, for example, dryers and washing machines as well.

Various features of the invention are set forth in the following claims. It should be understood that the invention is not limited in its application to the details of construction and arrangements of the components set forth herein. The invention is capable of other embodiments and of being practiced or carried out in various ways. It also being understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

We claim:

1. An appliance alarm for an appliance of a type providing a line power source of line-voltage alternating current, the appliance alarm comprising:

a housing providing a mounting element for attaching the appliance alarm to the appliance;

a conductor system providing an electrical connection between the appliance alarm and line power fl-urn the appliance; and a circuit card retained at least in part within the housing and including:

(a) a power converter converting line-voltage alternating current to logic level direct-current;

(b) a audio annunciator; and (c) a controller circuit receiving the logic level direct-current and providing an output line communicating with the audio annunciator to provide a modulated signal to the audio annunciator to produce a distinctive modulated audio tone;

further including an electrical switch having a switch operator extending from the housing to move between an open and closed state, the switch operator communicating with electrical contacts providing an electrical signal to the controller circuit;

wherein the switch is supported for motion by the housing and printed circuit board and include switch contacts electrically supported by the printed circuit board.

2. The appliance alarm of claim 1 wherein the electrical switch communicates between the logic level direct-current from the power converter and an input from the controller circuit.

3. The appliance, alarm of claim 1 wherein the electrical switch communicates between the conductor system providing electrical connection to line power and the power converter.

4. The appliance alarm of claim 1 wherein the switch operator moves between the open and closed states in a plane parallel to a plane of the circuit card.

5. The appliance alarm of claim 1 wherein the audio annunciator is a metallic disk including a coating of piezoelectric material, the metallic disk supported by and electrically communicating through its edges with the circuit card.

6. The appliance alarm of claim 1 wherein the housing provides a resonator chamber positioned adjacent to the audio annunciator.

7. The appliance alarm of claim 1 wherein the power converter employs multiple series-connected discrete resistors to provide a reduction in line voltage, the discrete resistors spaced over a surface, of the circuit card.

8. The appliance alarm of claim 1 wherein the housing includes an electrical connector shell allowing a mating connector to fit within the electrical connector shell and connect with connector pins attached to the circuit card.

9. An appliance alarm for an appliance of a type providing a line power source of line-voltage alternating current, the appliance alarm comprising:

a housing providing a mounting element for attaching the appliance alarm to the appliance;

a conductor system providing an electrical connection between the appliance alarm and line power from the appliance; and a circuit card retained at least in part within the housing and including:

(a) a power converter converting line-voltage alternating current to logic level direct-current;

(b) a audio annunciator; and (c) a controller circuit receiving the logic level direct-current and providing an output line communicating with the audio annunciator to provide a modulated signal to the audio annunciator to produce a distinctive modulated audio tone;

wherein the power converter provides a current flow through connectors connecting the power converter to line power of at least 100 milliamps and a voltage drop of less than 50 volts so that when an electrical switch is closed, a standard line voltage incandescent bulb in series with the power converter is substantially fully illuminated when the switch, is closed and turned off when the switch is open.

10. An appliance alarm for an appliance of a type providing a line power source of line-voltage alternating current, the appliance alarm comprising:

a housing providing a mounting element or attaching the appliance alarm to the appliance;

a conductor system providing an electrical connection between the appliance alarm and line power from the appliance; and a circuit card retained at least in part within the housing and including:

(a) a power converter converting line-voltage alternating current to logic level direct-current;

(b) a audio annunciator; and (c) a controller circuit receiving the logic level direct-current and providing an output line communicating with the audio annunciator to provide a modulated signal to the audio annunciator to produce a distinctive modulated audio tone;

wherein the conductor system further includes a low voltage electrical connector providing a logic level direct current signal to the controller circuit and wherein the controller circuit responds to the logic level direct-current signal by changing a modulated signal to provide a second distinctive modulated audio tone.

11. An appliance alarm for an appliance of a type providing a line power source of line-voltage alternating current, the appliance alarm comprising:

a housing providing a mounting element for attaching the appliance alarm to the appliance;

a conductor system providing an electrical connection between the appliance alarm and line power from the appliance; and a circuit card retained at least in part within the housing and including:

(a) a power converter convening line-voltage alternating current to logic level direct-current;

(b) a audio annunciator; and (c) a controller circuit receiving the logic level direct-current and providing an output line communicating with the audio annunciator to provide a modulated signal to the audio annunciator to produce a distinctive modulated audio tone;

wherein the controller circuit provides a first modulated signal for a first period of time to start an internal timer upon a starting of the first modulated signal and to provide a second modulated signal for a second period of time upon expiration of the timer.

* * * * *